US011313367B2

(12) United States Patent
Kim et al.

(10) Patent No.: US 11,313,367 B2
(45) Date of Patent: Apr. 26, 2022

(54) ROTARY COMPRESSOR WITH ROLLER OIL GROOVE

(71) Applicant: LG Electronics Inc., Seoul (KR)

(72) Inventors: Ki Sun Kim, Seoul (KR); Sangha Lee, Seoul (KR); Jaeyeol Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 15 days.

(21) Appl. No.: 16/880,158

(22) Filed: May 21, 2020

(65) Prior Publication Data

US 2021/0025389 A1 Jan. 28, 2021

(30) Foreign Application Priority Data

Jul. 24, 2019 (KR) ..... 10-2019-0089583

(51) Int. Cl.
*F04C 18/324* (2006.01)
*F04C 29/02* (2006.01)
*F04C 18/356* (2006.01)

(52) U.S. Cl.
CPC ..... *F04C 18/324* (2013.01); *F04C 18/356* (2013.01); *F04C 29/02* (2013.01)

(58) Field of Classification Search
CPC .. F04C 18/324; F04C 18/356; F04C 18/3564; F04C 29/02
See application file for complete search history.

(56) References Cited

U.S. PATENT DOCUMENTS

| | | | | |
|---|---|---|---|---|
| 9,074,600 | B2 * | 7/2015 | Karino | F04C 18/324 |
| 10,982,675 | B2 * | 4/2021 | Park | F04C 18/3564 |
| 2020/0200176 | A1 * | 6/2020 | Sotojima | F04C 18/356 |

FOREIGN PATENT DOCUMENTS

| | | |
|---|---|---|
| EP | 2589809 | 5/2013 |
| JP | H06257579 | 9/1994 |
| JP | 2008180178 | 8/2008 |
| JP | 2009299527 | 12/2009 |
| JP | 2010255594 | 11/2010 |
| JP | 2011127430 | 6/2011 |
| KR | 20110064668 | 6/2011 |

OTHER PUBLICATIONS

Machine translation of Japanese Patent Publication JP 2008-180178A, Inventor: Hirayama, Published in Japan on Aug. 7, 2008. (Year: 2008).*

Extended European Search Report in European Appln. No. 20176271.3, dated Oct. 27, 2020, 7 pages.

Korean Office Action in Korean Appln. No. 10-2019-0089583, dated Sep. 15, 2020, 13 pages (with English translation).

* cited by examiner

*Primary Examiner* — Mary Davis
(74) *Attorney, Agent, or Firm* — Fish & Richardson P.C.

(57) ABSTRACT

A rotary compressor includes a roller that is provided with oil grooves concavely formed in a centrifugal direction from an inner circumferential surface of the roller facing an eccentric portion. The oil grooves are disposed at positions not overlapping an intake and a discharge port in an axial direction.

18 Claims, 12 Drawing Sheets

ROTARY COMPRESSOR WITH ROLLER OIL GROOVE

CROSS-REFERENCE TO RELATED APPLICATION

This application claims priority to and the benefit of Korean Patent Application No. 2019-0089583, filed on Jul. 24, 2019, the disclosure of which is incorporated herein by reference in its entirety.

TECHNICAL FIELD

The present disclosure relates to a compressor, and more specifically, to a rotary compressor.

BACKGROUND

Generally, a compressor refers to an apparatus which compresses a refrigerant. Compressors can be classified into a reciprocating type, a centrifugal type, a vane type, and a scroll type.

Among the above, a rotary compressor is a compressor using a method of compressing a refrigerant using a roller (or referred to as a "rolling piston") and a vane. In the rotary compressor, a roller eccentrically rotates in a compression space of a cylinder. Further, the vane comes into contact with an outer circumferential surface of the roller to partition the compression space of the cylinder into a suction chamber and a discharge chamber.

According to the above-described rotary compressor, since the roller revolves in the cylinder, the vane inserted into and mounted in the cylinder moves linearly. Accordingly, a compression chamber of which a volume is variable is formed in each of the suction chamber and the discharge chamber formed in the cylinder, and thus suction, compression, and discharge of the refrigerant are performed.

In the conventional rotary compressor having the above-described configuration, there is a problem in that the refrigerant leaks between the roller and the vane and thus the performance of the compressor is degraded.

Recently, in order to solve leakage between the roller and the vane, a rotary compressor having a combined vane-roller structure, which is a structure in which the vane is inserted into and combined with the roller, is introduced.

FIG. 1 is a longitudinal sectional view illustrating an example of a rotary compressor having the conventional combined vane-roller structure, FIG. 2 is a lateral sectional view illustrating a compression mechanism of the rotary compressor shown in FIG. 1, and FIG. 3 is a schematic diagram for describing an operation of a main component of the rotary compressor shown in FIG. 1.

Referring to FIGS. 1 and 2, in the conventional rotary compressor, an electric motor part and a compression mechanism driven by the electric motor part are accommodated in an airtight container 1, and oil accumulates at a bottom portion of the airtight container 1.

The compression mechanism includes a cylinder 5, an upper bearing 7 and a lower bearing 8 fastened to both cross-sections of the cylinder 5 to form a cylinder chamber 6, a piston 9 (or a roller, hereinafter, referred to as a "roller") fitted onto an eccentric portion 4A of the shaft 4 located between the upper bearing 7 and the lower bearing 8, and a vane 11 which reciprocates in a vane groove 10 formed in a radial direction of the cylinder 5.

Further, a front end portion 11A of the vane 11 is connected to a fitting portion 9A formed on a roller 9 to be revolvable, and accordingly, a suction chamber 12 and a compression chamber 13 divided by the vane 11 can be formed in the cylinder chamber 6.

According to the rotary compressor having the above-described configuration, a volume of each of the suction chamber 12 and the compression chamber 13 is changed by a revolving motion of the roller 9 and a reciprocating motion of the vane 11 according to rotation of the shaft 4. Due to the volume change, a refrigerant suctioned into the suction chamber 12 through a suction port 17 is compressed and thus becomes a high temperature high pressure refrigerant. Like the above, the compressed refrigerant is discharged into the airtight container 1 after passing through a discharge port 18 and a discharge silencer chamber 19 in the compression chamber 13.

In addition, oil can be suctioned into the shaft 4 by an oil pump provided on the shaft 4. The suctioned oil is supplied between slide surfaces in the compression mechanism, for example, the eccentric portion 4A of the shaft 4 and an inner circumferential surface 9B of the roller 9, and an outer circumferential surface of the roller 9 and an inner circumferential surface of the cylinder 5 through the hollow provided in the shaft 4 to perform lubrication.

However, as shown in FIG. 3, in the conventional rotary compressor, when the shaft 4 rotates, a rotational moment acts on the roller 9 due to the viscosity of the oil interposed between the eccentric portion 4A of the shaft 4 and the inner circumferential surface 9B of the roller 9. Like the above, the rotational moment which acts on the roller 9 acts in a rotation direction of the shaft 4 with respect to the eccentric portion 4A of the shaft 4.

Since the rotational moment is supported by the front end portion 11A of the vane 11, a frictional resistance between the vane 11 and the vane groove 10 acts on contact points 201 and 202 of the vane 11 and the vane groove 10 as a reaction force of the support force. Like the above, due to the acting frictional resistance, a problem occurs that sliding loss, which is generated when the vane 11 reciprocates in the vane groove 10, increases.

Japanese Laid-Open Patent No. 2011-127430 (invention title: A Rotary Compressor) discloses a configuration in which a narrow portion is formed on an inner circumferential surface of a roller as a configuration for solving the problem.

FIG. 4 is a lateral sectional view illustrating a compression mechanism of the conventional rotary compressor, and FIG. 5 is a perspective view illustrating a roller shown in FIG. 4.

Referring to FIGS. 4 and 5, an inner circumferential surface of the roller 9 provided in the conventional rotary compressor includes a broad slide portion 9C and a narrow slide portion 9D.

The broad slide portion 9C is a slide surface facing the eccentric portion 4A of the shaft 4 and is a slide surface having a relatively large width in a height direction of the roller 9. Further, the narrow slide portion 9D is a slide surface facing the eccentric portion 4A of the shaft 4, and is a slide surface having a relatively smaller width than the broad slide portion 9C in the height direction of the roller 9.

A contact area between the inner circumferential surface of the roller 9 and the shaft 4 is formed to be smaller in the narrow slide portion 9D than in the broad slide portion 9C. Accordingly, in the narrow slide portion 9D, a contact area between the outer circumferential surface of the shaft 4 and the inner circumferential surface of the roller 9 decreases, and a viscous force of the oil proportional to the contact area can be decreased.

Accordingly, the rotational moment which acts in the rotational direction of the shaft 4 of the circumferential direction with respect to the eccentric portion 4A of the shaft 4 can be decreased. Accordingly, the frictional resistance between the vane 11 and the vane groove 10 generated when the vane 11 reciprocates in the vane groove 10 can be reduced, and the sliding loss generated when the vane 11 reciprocates in the vane groove 10 can be decreased.

However, according to the above-described conventional rotary compressor, the following problems occur.

First, leakage can occur in some types of rotary compressors.

In a rotary compressor of a type in which a plurality of compression mechanisms are vertically connected, a middle plate is disposed between the compression mechanism and the compression mechanism. The insides of the compression mechanisms can be divided by the middle plate.

In the above-described type rotary compressor, a refrigerant may be introduced into the insides of the compression mechanisms through the inside of the middle plate. That is, a suction port can be provided in the middle plate, and the refrigerant introduced through the suction port can be introduced into suction chambers of the compression mechanisms through an intake formed in the middle plate.

In this case, the intake formed in the middle plate can be disposed at a position vertically overlapping the roller 9. For example, when the roller 9 which revolves in the cylinder 5 is disposed at a position most adjacent to the intake, at least a portion of the roller 9 and the intake can be located at a vertically overlapping position.

In this time, a position of the narrow slide portion 9D of the roller 9 can vertically overlap the position of the intake, and in this case, a situation that the refrigerant introduced into the suction chamber through the intake leaks to the outside of the suction chamber through a space formed in the narrow slide portion 9D can occur.

According to the conventional rotary compressor, the narrow slide portion 9D is formed in a region biased to a slide surface of the suction chamber 12 on the roller 9, more specifically, in a range of 30 to 180° in the rotation direction of the shaft 4.

Accordingly, a possibility that the narrow slide portion 9D and the intake vertically overlap increases, and thus, a possibility of leakage of the refrigerant through the narrow slide portion 9D increases.

Secondarily, a portion in the inner circumferential surface of the roller 9 which does not come into contact with the eccentric portion 4A of the shaft 4 is generated, and accordingly, a surface pressure per unit area received by the roller 9 increases.

In the narrow slide portion 9D, contact between the inner circumferential surface of the roller 9 and the shaft 4 does not occur. Accordingly, an area of the inner circumferential surface of the roller 9 which comes into contact with the eccentric portion 4A of the shaft 4 decreases, and thus, the surface pressure per unit area received by the roller 9 increases.

Thirdly, a problem occurs that lubrication between the shaft 4 and the roller 9 at the compression chamber 13, which receives the most load from the eccentric portion 4A of the shaft 4, becomes weak.

According to the conventional rotary compressor, the narrow slide portion 9D is formed in a region biased to a slide surface of the suction chamber 12 on the roller 9 (in a range of 30 to 180° in the rotation direction of the shaft 4).

Like the above, in a region where the narrow slide portion 9D is formed on the roller 9, since a space necessary for securing oil can be sufficiently provided, the lubrication between the shaft 4 and the roller 9 can be smoothly performed.

However, in a region where the narrow slide portion 9D is not formed on the roller 9, that is, a region biased to a slide surface of the compression chamber 13 on the roller 9, since it is difficult to sufficiently provide the space necessary for securing oil, the lubrication between the shaft 4 and the roller 9 becomes relatively weak.

Fourthly, a problem occurs that difficulty of assembling the roller 9 increases and possibility of an assembly error increases.

According to the conventional rotary compressor, the narrow slide portion 9D is formed in a shape in which an upper portion of the inner circumferential surface of the roller 9 is partially recessed. That is, in the roller 9, an upper shape and a lower shape are formed in different shapes.

Accordingly, since an assembly work of the roller 9 should be performed while distinguishing upper and lower portions of the roller 9, difficulty of the assembly work of the roller 9 is increased, and accordingly, possibility of the assembly error is increased.

(Patent Document 1) Japanese Laid-Open Patent No. 2011-127430 (Jun. 30, 2011)

SUMMARY

The present disclosure is directed to providing a rotary compressor capable of improving the lubrication performance between a shaft and a roller in addition to restraining leakage of a refrigerant through the roller.

Further, the present disclosure is directed to providing a rotary compressor of which a structure is improved so that the lubrication performance between a shaft and a roller is improved and an increase of a surface pressure per unit area received by the roller is prevented.

In addition, the present disclosure is directed to providing a rotary compressor of which a structure is improved so that lubrication at a portion which receives a great deal of load from an eccentric portion of a shaft may also be effectively performed.

In addition, the present disclosure is directed to providing a rotary compressor of which a structure is improved so that assembly of the roller is easy and possibility of an occurrence of an assembly error of the roller decreases.

Particular implementations of the present disclosure described herein provide a rotary compressor that includes a cylinder, a ring-shaped roller, a vane, a shaft, a first member, and a second member. The cylinder may axially extend between a first axial end and a second axial end and define a compression space. The ring-shaped roller may be received in the cylinder and configured to compress a substance in the compression space. The vane may be connected to the roller and configured to divide the compression space into a suction chamber and a compression chamber. The shaft may include an eccentric portion configured to engage with an inner circumference of the roller. The eccentric portion may be configured to, based on rotation of the shaft, eccentrically rotate to revolve the roller around the shaft. The first member may be disposed at the first axial end of the cylinder and include an intake port fluidly connected to the suction chamber. The second member may be disposed at the second axial end of the cylinder and include a discharge port fluidly connected to the compression chamber. The roller may include at least one oil groove that is defined at the inner circumference of the roller and faces the eccentric portion. The at least one oil groove may be spaced apart from, in a circumferential direction, the intake port of the first member and the discharge port of the second member.

In some implementations, the rotary compressor described herein can optionally include one or more of the following features. The at least one oil groove may have a first end and a second end and extend between the first end and the second end along the inner circumference of the roller. A first virtual line extends between a rotation axis of the shaft and the vane and lies on a virtual plane that is perpendicular to the rotation axis. A second virtual line extends between the rotation axis of the shaft and the intake port and lies on the virtual plane. A third virtual line extends between the rotation axis of the shaft and the discharge port and lies on the virtual plane. A fourth virtual line extends between the rotation axis of the shaft and the first end of the at least one oil groove and lies on the virtual plane. A fifth virtual line extends between the rotation axis of the shaft and the second end of the at least one oil groove and lies on the virtual plane. A first angle is defined between the first virtual line and the second virtual line in a first angular direction. A second angle is defined between the first virtual line and the third virtual line in the first angular direction. A third angle is defined between the fourth virtual line and the rotation axis of the shaft in the first angular direction. A fourth angle is defined between the fifth virtual line and the rotation axis of the shaft in the first angular direction. Each of the third angle and the fourth angle may have a value that ranges between a first value of the first angle and a second value of the second angle. The second virtual line may extend between the rotation axis of the shaft and an end of the intake port that is farthest from the first virtual line. The third virtual line may extend between the rotation axis of the shaft and an end of the discharge port that is farthest from the first virtual line. The first value of the first angle may range from 0 to 50°. The second value of the second angle may range from 310 to 360°. The value of each of the third angle and the fourth angle may range from 50 to 310°. The first angle may be greater than or equal to a first subtraction value of subtracting the second angle from 360. The third angle may be greater than or equal to the first angle and smaller than a second subtraction value of subtracting the first angle from 360. The fourth angle may be greater than the third angle and smaller than or equal to the second value. The at least one oil groove may be defined as continuously extending along the inner circumference of the roller in a range between the first angle and the second subtraction value. The at least one oil groove may be symmetrically positioned with respect to the first virtual line. The at least one oil groove may be defined at a first axial end of the roller. The at least one oil groove may be recessed from the first axial end of the roller by a predetermined depth such that the eccentric portion does not extend axially beyond an axial end of the at least one oil groove. The at least one oil groove may be at least one first oil groove. The roller may include at least one second oil groove defined at a second axial end of the roller that is axially opposite to the first axial end of the roller. The at least one first oil groove and the at least one second oil groove may be symmetrically positioned with respect to the rotation axis of the roller. The at least one oil groove may have an oil accommodation space defined by the first member and the at least one oil groove. The oil accommodation space may be fluidly connected to a gap between the inner circumference of the roller and an outer circumference of the eccentric portion. The at least one first oil groove may have a first oil accommodation space defined by the first member and the at least one first oil groove. The at least second oil groove may have a second oil accommodation space defined by the second member and the at least one second oil groove. Each of the first and second oil accommodation spaces may be fluidly connected to a gap between the inner circumference of the roller and an outer circumference of the eccentric portion. The at least one oil groove may include a C-shape having opposite ends that are circumferentially spaced from each other along the inner circumference of the roller. The first member may be a plate that covers the first axial end of the cylinder. The second member may be a bearing that covers the second axial end of the cylinder. The cylinder may include a vane slot. The vane may be at least partially inserted in the vane slot and configured to linearly move along the vane slot to divide the compression space into the suction chamber and the compression chamber.

In a rotary compressor which is one embodiment of the present disclosure, a roller is provided with oil grooves concavely formed in a centrifugal direction from an inner circumferential surface of the roller facing an eccentric portion, and the oil grooves are disposed at positions not overlapping an intake and a discharge port in an axial direction.

According to this configuration, oil supply between a shaft and the roller may be smoothly performed and an occurrence of leakage of a refrigerant through the oil grooves may be effectively restrained.

Further, in another embodiment of the present disclosure, oil grooves are concavely formed in an inner circumferential surface of a roller facing an eccentric portion, and the oil grooves are formed in a shape located in a region biased to a slide surface of a compression chamber in addition to a region biased to a slide surface of a suction chamber.

According to this configuration, the lubrication performance of inner components of a compression part may be further improved, and friction loss in the compression part may be further effectively decreased.

Further, in still another embodiment of the present disclosure, oil grooves are concavely formed in an inner circumferential surface of a roller facing an eccentric portion, and the oil grooves are formed in a region not connected to an intake.

In addition, in yet another embodiment of the present disclosure, oil grooves are concavely formed in an inner circumferential surface of a roller facing an eccentric portion, and the oil grooves are formed over the entire region in a circumferential direction of the roller except for a region which may be connected to an intake.

In addition, in yet another embodiment of the present disclosure, oil grooves are concavely formed in an inner circumferential surface of a roller facing an eccentric portion, and the oil grooves are disposed at one side and the other side of the roller in an axial direction.

According to this configuration, the oil grooves may be provided in the roller as long as possible and as many as possible, and thus, a weight of the roller may be reduced.

Further, in yet another embodiment of the present disclosure, a shape of one side of a roller in an axial direction and a shape of the other side of the roller in the axial direction are the same.

According to this configuration, the roller does not require direction classification according to a vertical direction, and thus the roller may be more easily assembled.

According to an aspect of the present disclosure, there is provided a rotary compressor including: cylinders each including a compression space; a ring-shaped roller configured to compress a refrigerant in the compression space; a vane connected to the roller and at least partially inserted into a vane slot formed in the cylinders to be linearly movable to divide the compression space into a suction chamber and a compression chamber; an eccentric portion which is rotatably coupled to an inner side in a radial direction of the roller and eccentrically rotates so that the roller revolves; a shaft coupled to an inner side in a radial direction of the eccentric portion to eccentrically rotate the eccentric portion; a first member disposed at one side in an axial direction of each of the cylinders and provided with an intake connected to the suction chamber; and a second member disposed at the other side in the axial direction of each of the cylinders and provided with a discharge port connected to the compression chamber, wherein the roller is provided with oil grooves concavely formed in a centrifugal direction from an inner circumferential surface of the roller facing the eccentric portion, and the oil grooves are disposed at positions not overlapping the intake and the discharge port in an axial direction.

Further, with respect to a first virtual line which connects a rotation center of the shaft and the vane, when an angle between the first virtual line and a second virtual line, which connects the rotation center of the shaft and a point of the intake which is farthest away from the first virtual line is a first angle and an angle between the first virtual line and a third virtual line, which connects the rotation center of the shaft and a point of the discharge port which is farthest away from the first virtual line is a second angle, each of an angle between a fourth virtual line, which connects the rotation center of the shaft and one end in a circumferential direction of the oil groove and the first virtual line and an angle between a fifth virtual line, which connects the rotation center of the shaft and the other end in the circumferential direction of the oil groove and the first virtual line, may be set as a range between the first angle and the second angle.

In addition, the first angle may be 0 to 50°, the second angle may be 310 to 360°, and each of the angle between the fourth virtual line and the first virtual line and the angle between the fifth virtual line and the first virtual line may be set as a range between 50 to 310°.

In addition, in the case in which the first angle is $\alpha°$ and the second angle is $\beta°$, when $\alpha$ is greater than or equal to $360°-\beta°$, the angle between the first virtual line and the fourth virtual line may be set as an angle greater than or equal to $\alpha°$ and smaller than $360°-\alpha°$, and the angle between the first virtual line and the fifth virtual line may be set as an angle greater than the angle between the first virtual line and the fourth virtual line and smaller than or equal to $360°-\alpha°$.

In addition, the oil grooves may be formed to be continuously connected along the circumferential direction in a range of $\alpha°$ to $360°-\alpha°$.

In addition, the oil grooves may be symmetrically formed with respect to the first virtual line.

In addition, the oil grooves may be concavely formed toward a center in an axial direction of the roller from an end portion of the roller in the axial direction.

In addition, the oil grooves may be formed to be recessed from the end portion of the roller in the axial direction by a predetermined depth and formed to a depth in which the eccentric portion does not protrude to an outer side in an axial direction of the oil groove.

In addition, the oil grooves may be formed in one side end portion of the roller in the axial direction and the other side end portion of the roller in the axial direction.

In addition, a pair of oil grooves may be symmetrically formed with respect to the center in the axial direction of the roller.

In addition, an oil accommodation space surrounded by the first member and the oil groove or the second member and the oil groove may be formed in each of the oil grooves, and the oil accommodation space may be connected to a gap between the inner circumferential surface of the roller and an outer circumferential surface of the eccentric portion.

In addition, each of the oil grooves may be formed in a C shape of which both end portions in a circumferential direction are disposed to be spaced apart from each other.

In addition, the first member may be a middle plate configured to cover one side of the cylinder in an axial direction, and the second member may be a bearing configured to cover the other side of the cylinder in the axial direction.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
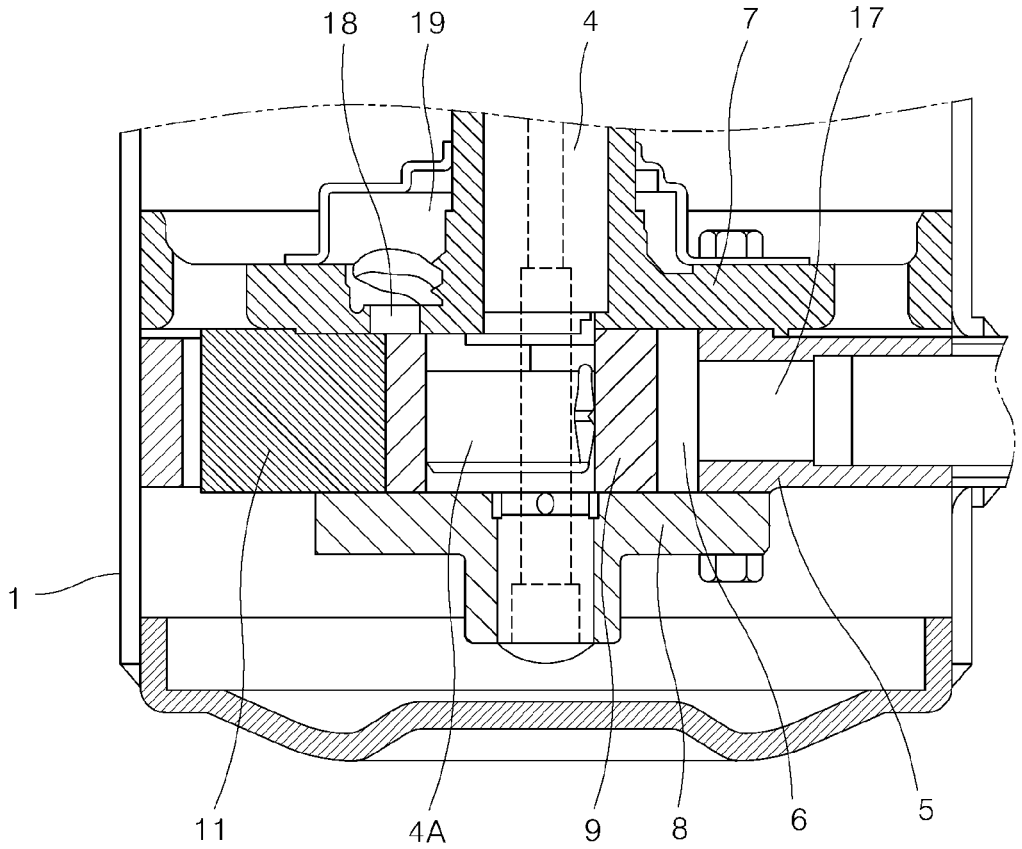
FIG. 1 is a longitudinal sectional view illustrating an example of a rotary compressor having the conventional combined vane-roller structure.
Figure 2:
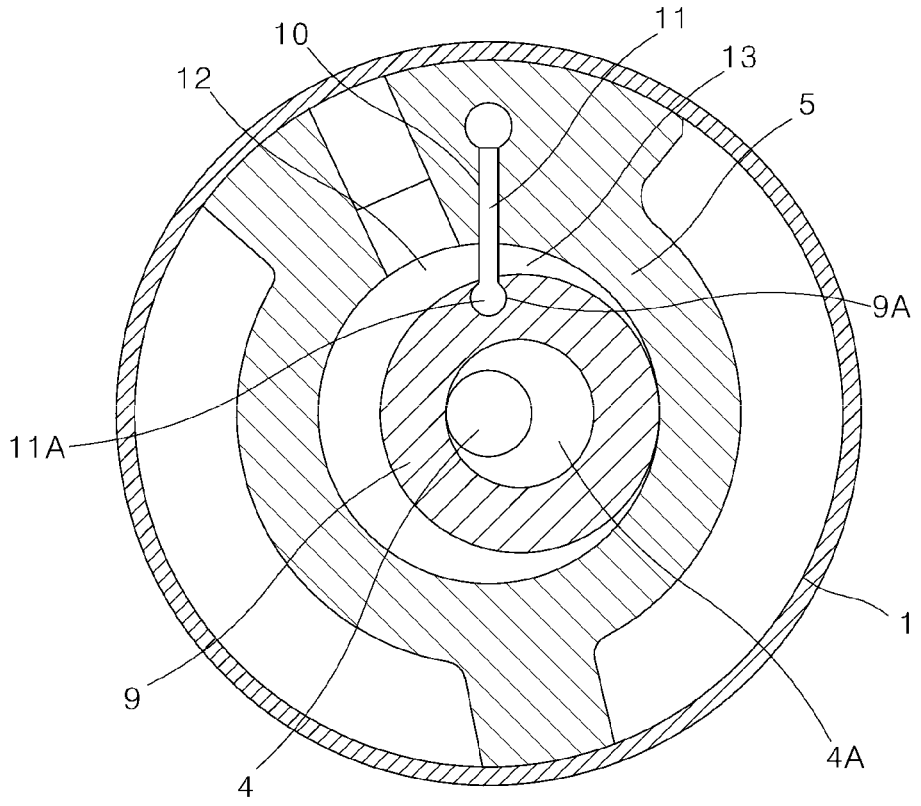
FIG. 2 is a lateral sectional view illustrating a compression mechanism of the rotary compressor shown in FIG. 1.
Figure 3:
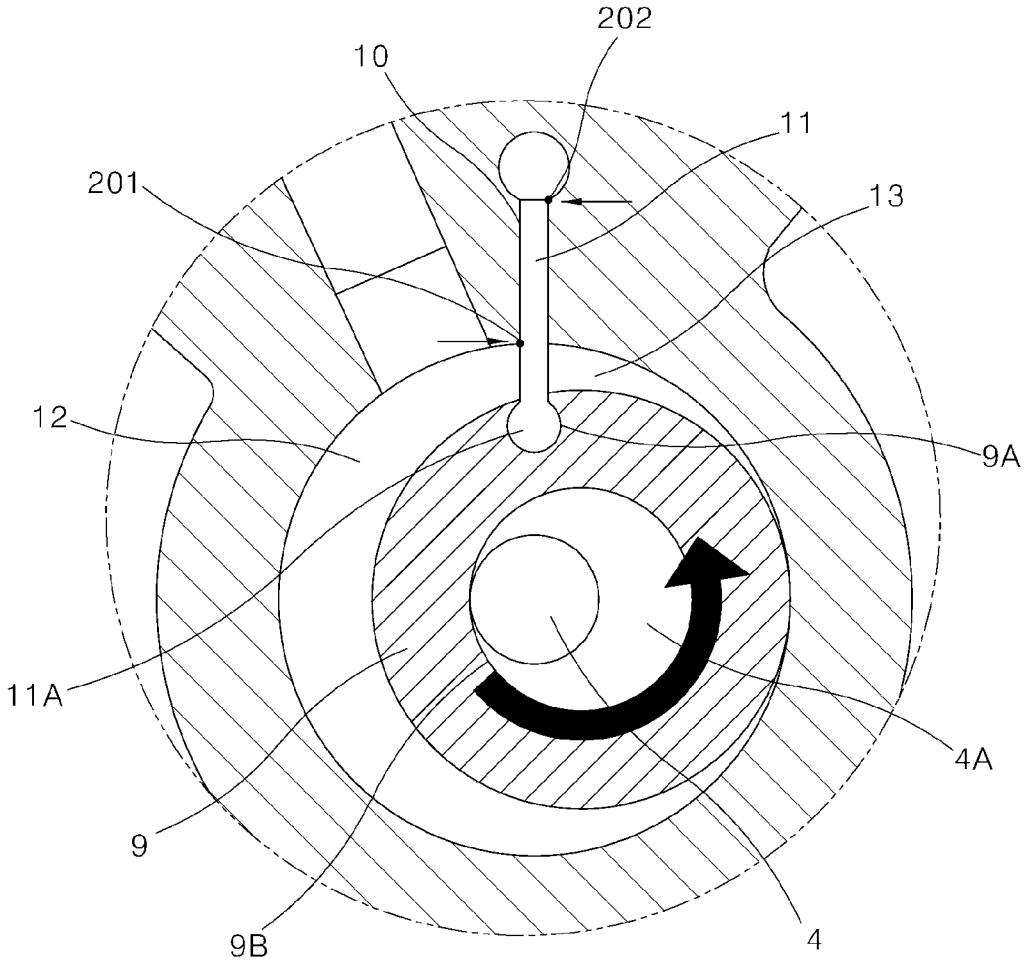
FIG. 3 is a schematic diagram for describing an operation of a main component of the rotary compressor shown in FIG. 1.
Figure 4:
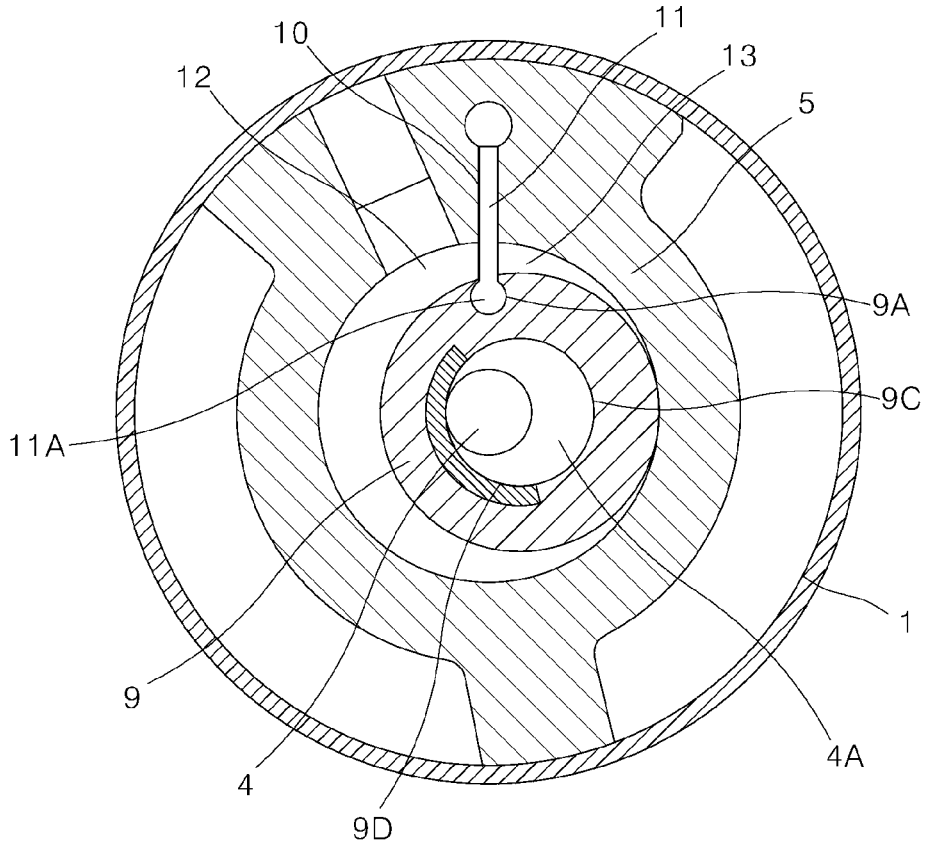
FIG. 4 is a lateral sectional view illustrating the compression mechanism of the conventional rotary compressor.

Hereinafter, embodiments of a rotary compressor according to the present disclosure will be described with reference to the accompanying drawings. Thicknesses of lines, sizes of components, or the like shown in the drawings may be shown to be exaggerated for clarity and convenience of the description. Further, terms which will be described later are terms defined in consideration of functions in the present disclosure and may be various according to purposes or conventions of an operator or a user. Accordingly, the terms should be defined on the basis of the content throughout the specification.

[Overall Structure of Rotary Compressor]

Figure 6:
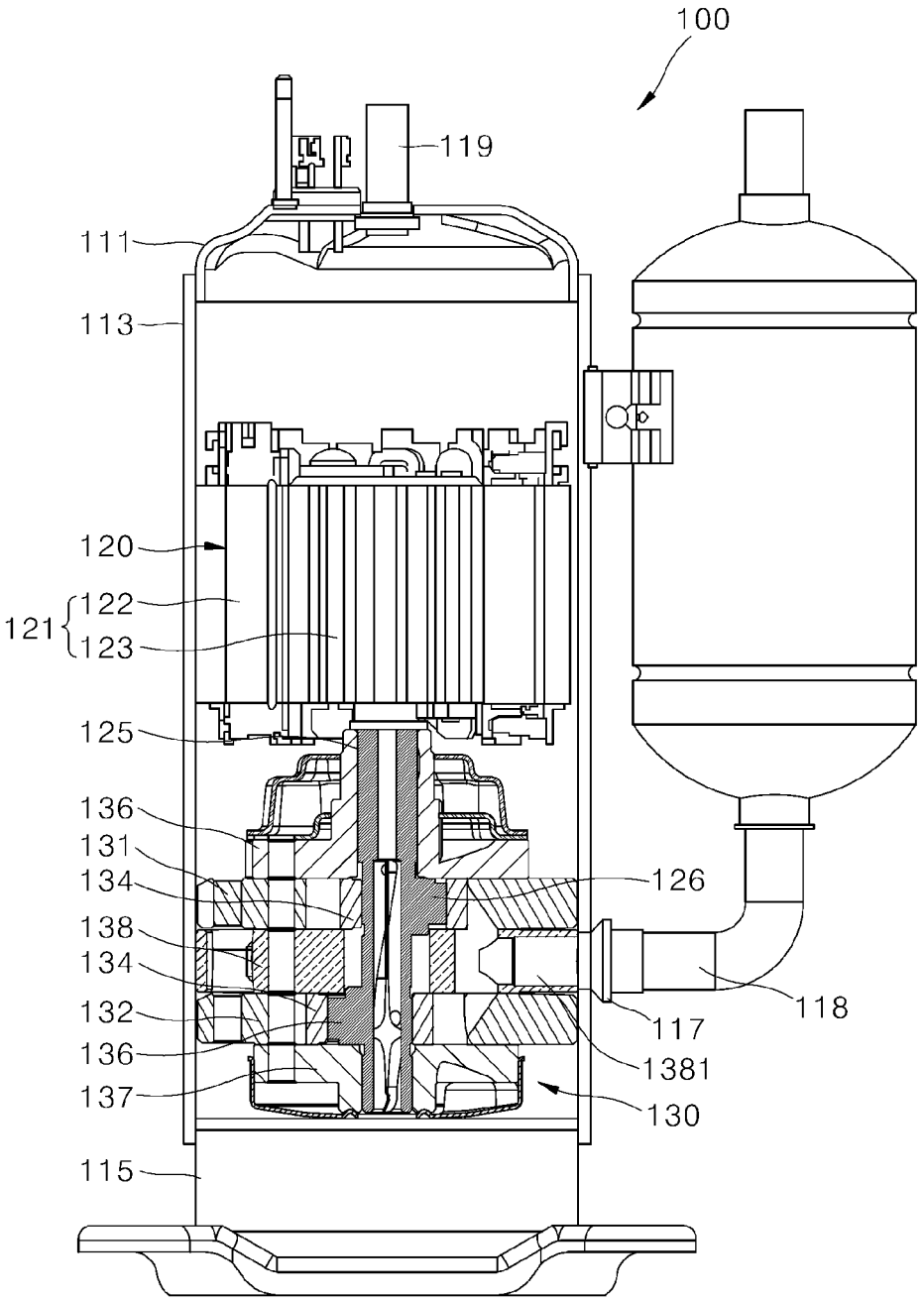
FIG. 6 is a longitudinal sectional view schematically illustrating a structure of a rotary compressor according to one embodiment of the present disclosure.
Figure 7:
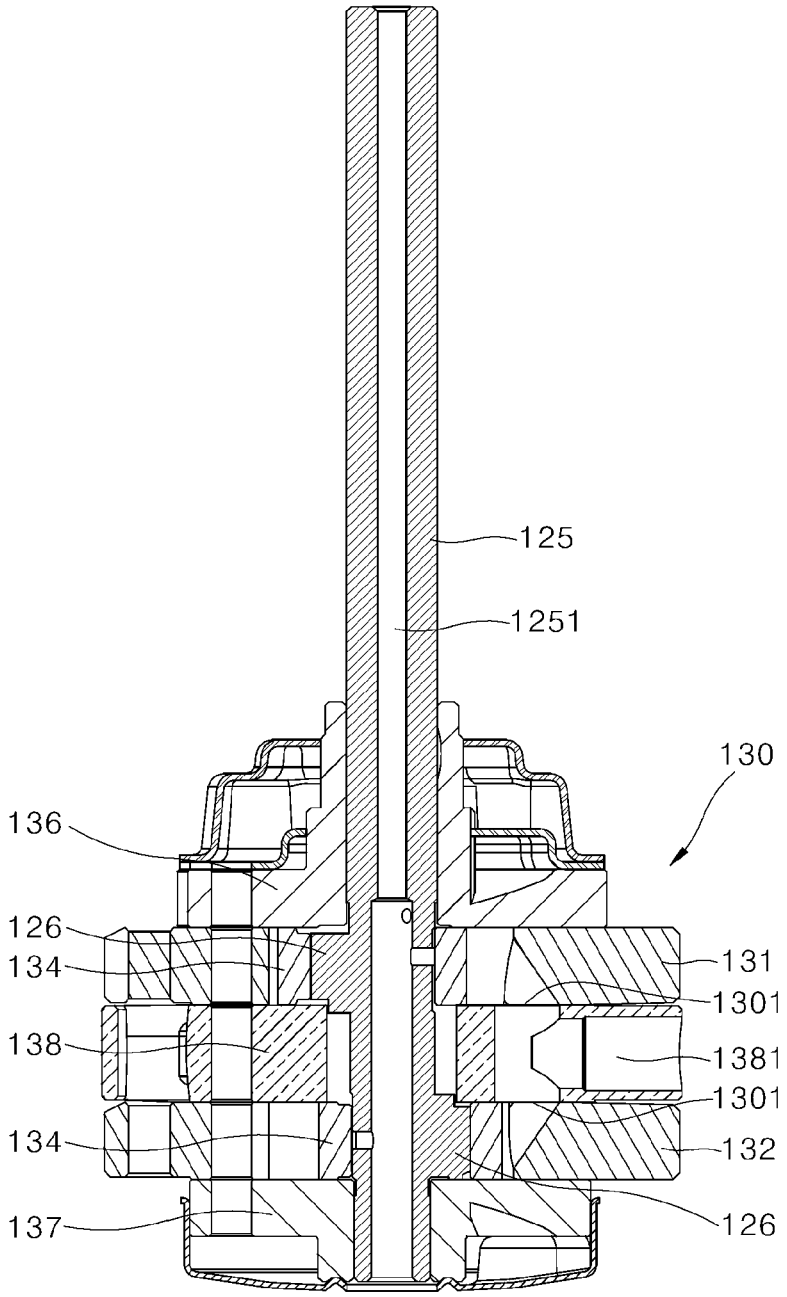
FIG. 7 is a cross-sectional view illustrating a compression part of the rotary compressor shown in FIG. 6 in a separated state.
Figure 8:
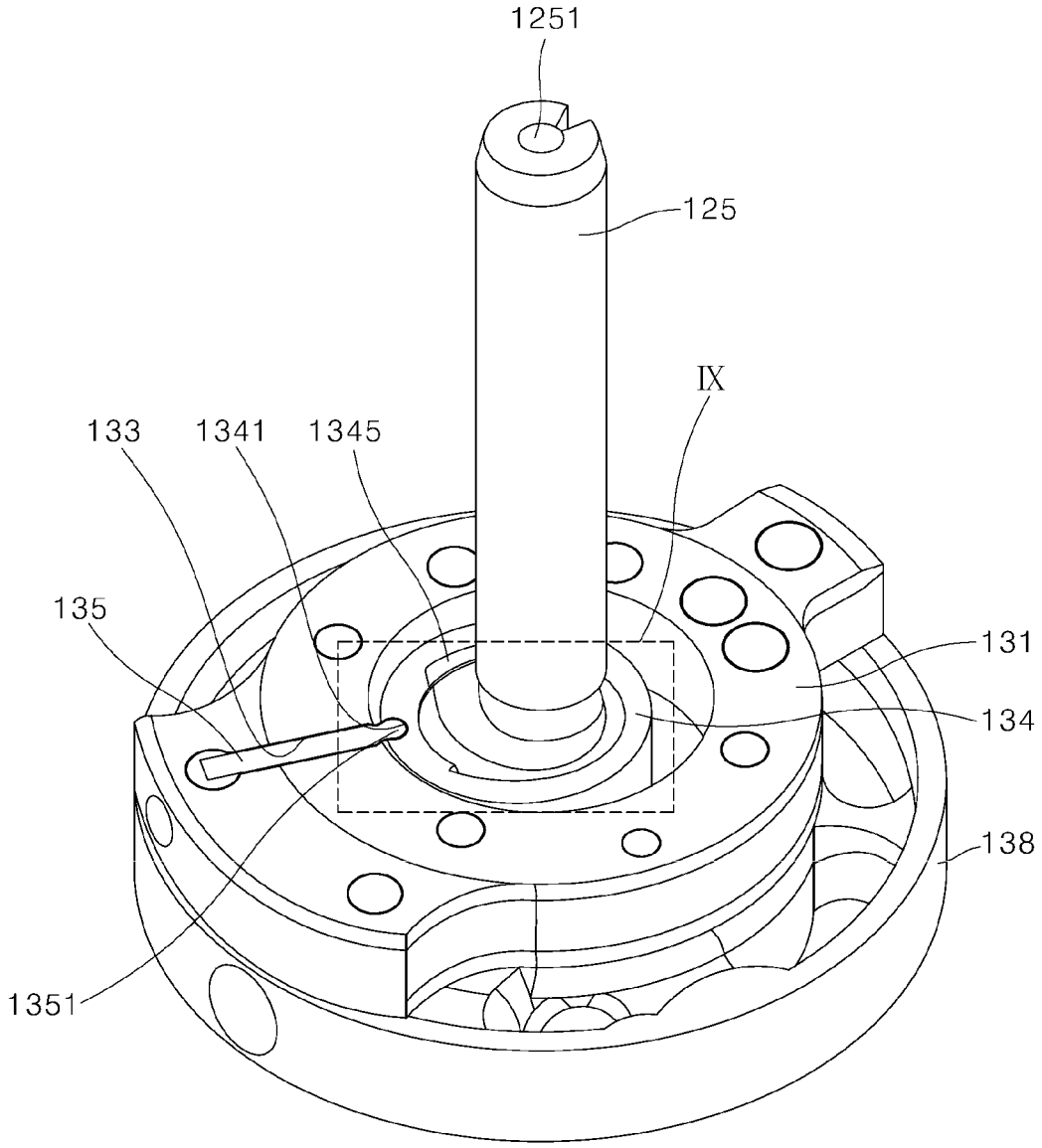
FIG. 8 is a perspective view illustrating some components of the compression part shown in FIG. 7 in a separated state.

FIG. 6 is a longitudinal sectional view schematically illustrating a structure of the rotary compressor according to one embodiment of the present disclosure, FIG. 7 is a cross-sectional view illustrating a compression part of the rotary compressor shown in FIG. 6 in a separated state, and FIG. 8 is a perspective view illustrating some components of the compression part shown in FIG. 7 in a separated state.

Referring to FIGS. 6 and 7, a rotary compressor 100 according to a first embodiment of the present disclosure may include a case 110, a driving part 120, and a compression part 130.

The case 110 forms an exterior of the rotary compressor 100. In the case 110, an inner space which accommodates the driving part 120 and the compression part 130 may be formed. As an example, the case 110 may be formed in a cylindrical shape having a length extending along an axial direction.

The case 110 may include an upper shell 111, a middle shell 113, and a lower shell 115. The driving part 120 and the compression part 130 may be fixed to the inside of the middle shell 113. Further, the upper shell 111 and the lower shell 115 may be respectively disposed on and under the middle shell 113. The upper shell 111 and the lower shell 115 restrict exposure of components disposed in the case 110.

The driving part 120 may be accommodated in the inner space of the case 110 and disposed on the compression part 130. The driving part 120 serves to provide power for compressing a refrigerant and may include a motor 121 and a shaft 125.

The motor 121 may include a stator 122 and a rotor 123. The stator 122 may be fixed to the inside of the case 110 and, more specifically, to the inside of the middle shell 113. The rotor 123 may be disposed to be spaced apart from the stator 122, and may be disposed at an inner side of a radial direction of the stator 122.

When power is applied to the stator 122, the rotor 123 rotates due to a force generated by a magnetic field formed between the stator 122 and the rotor 123. As described above, the rotating rotor 123 transfers a rotational force to the shaft 125 passing through a center of the rotor 123.

The shaft 125 is rotated by the rotor 123 and may be connected to a roller 134 of the compression part 130 which will be described later. The shaft 125 may provide power for compressing the refrigerant by providing power to the roller 134 for revolution the roller 134.

Further, a suction port 117 may be provided at one side of the middle shell 113, and a discharge pipe 119 may be connected to one side of the upper shell 111. The suction port 117 may be connected to a suction pipe 118 connected to an evaporator, and the discharge pipe 119 may be connected to a condenser.

Referring to FIGS. 6 to 8, the compression part 130 may include cylinders 131 and 132, a first bearing 136, a second bearing 137, a roller 134, and a vane 135.

Each of the cylinders 131 and 132 are formed in a ring shape. In each of the cylinders 131 and 132, a compression space in which the refrigerant is compressed may be formed. The inside of each of the cylinders 131 and 132 may be formed so that passing therethrough in an axial direction is possible.

In the embodiment, an example in which the compression part 130 includes two cylinders 131 and 132 is described. Accordingly, the compression part 130 may include a first cylinder 131 and a second cylinder 132. The first cylinder 131 and the second cylinder 132 may be arranged in the axial direction. That is, the first cylinder 131 is disposed at one side in the axial direction of the second cylinder 132 (hereinafter, referred to as "an upper side"), and the second cylinder 132 is disposed at the other side in the axial direction of the first cylinder 131 (hereinafter, referred to as "a lower side").

The first bearing 136 may be disposed on the first cylinder 131, and the second cylinder 132 may be disposed under the first cylinder 131. In this case, a middle plate 138 may be disposed between the first cylinder 131 and the second cylinder 132.

Further, the middle plate 138 may be disposed on the second cylinder 132, and the second bearing 137 may be disposed under the second cylinder 132.

The first bearing 136 and the second bearing 137 are respectively disposed on the first cylinder 131 and under the second cylinder 132, and the shaft 125 which passes through the first cylinder 131 and the second cylinder 132 may be rotatably supported. Further, the middle plate 138 is disposed between the first cylinder 131 and the second cylinder 132 to partition a space in the first cylinder 131 and a space in the second cylinder 132.

An upper portion of the space formed in the first cylinder 131 may be sealed by the first bearing 136. Further, a lower portion of the space formed in the first cylinder 131 may be sealed by the middle plate 138. As described above, the compression space may be formed in the first cylinder 131 sealed by the first bearing 136 and the middle plate 138.

Further, an upper portion of the space formed in the second cylinder 132 may be sealed by the middle plate 138. In addition, a lower portion of the space formed in the second cylinder 132 may be sealed by the second bearing 137. As described above, the compression space may be formed in the second cylinder 132 sealed by the middle plate 138 and the second bearing 137.

The roller 134 and the vane 135 may be respectively disposed in the compression spaces of the cylinders 131 and 132.

The roller 134 may be coupled to the shaft 125 and rotatably coupled to the eccentric portion 126 eccentrically protruding from the shaft 125. The roller 134 may be formed in a ring shape, and the eccentric portion 126 may be rotatably coupled to an inner circumferential surface of the roller 134. The roller 134 may revolve due to the eccentric portion 126 when the shaft 125 rotates. In this case, the roller 134 may revolve in the cylinders 131 and 132 while coming into contact with inner circumferential surfaces of the cylinders 131 and 132.

The eccentric portion 126 is coupled to the shaft 125 and is coupled to an outer side in a radial direction of the shaft 125. The eccentric portion 126 is eccentrically coupled to the shaft 125 and may be rotatably coupled to an inner side in a radial direction of the roller 134, that is, the inner circumferential surface of the roller 134. Like the above, the eccentric portion 126 coupled to the inner circumferential surface of the roller 134 may be eccentrically rotated by the shaft 125 so that the roller 134 may revolve.

The vane 135 has one side coupled to the roller 134 and divides the compression space into a suction chamber and a compression chamber. The vane 135 may be inserted into a vane slot 133 provided in each of the cylinders 131 and 132.

According to the embodiment, the vane slot 133 is formed to pass through each of the cylinders 131 and 132 in a radial direction and forms a straight path in each of the cylinders 131 and 132. The vane 135 is provided to be capable of reciprocating in a linear direction in the vane slots 133 formed as described above.

Further, a hinge head 1351 may be provided at one side of the vane 135, and the hinge head 1351 may be coupled to a roller groove 1341 provided in an outer circumferential surface of the roller 134.

The hinge head 1351 is formed to protrude toward one side in the radial direction from the vane 135 and may be formed in a round shape. Further, the roller groove 1341 may be formed in a round groove shape corresponding to a shape of the hinge head 1351. Since the hinge head 1351 is fit-coupled to the roller groove 1341, coupling of the roller 134 and the vane 135 may be maintained even during a revolving process of the roller 134.

In the embodiment, the vane 135 is illustrated as being formed of an SUJ2 steel material. SUJ2 steel is steel widely used as bearing steel and is a material which is easy to process and shape and has high impact resistance and high wear resistance. The SUJ2 steel is suitable as a material for manufacturing the vane 135 which should be repeatedly moved under a high pressure in the compression space.

In the compression part 130, with respect to the vane 135, the suction chamber is located at a left portion of the vane 135, and the compression chamber is located at a right portion of the vane 135. That is, the vane 135 may be coupled to the roller 134 to divide the compression space in each of the cylinders 131 and 132 into the suction chamber and the compression chamber.

An intake 1301 and a discharge port 1303 may be respectively connected to the suction chamber and the compression chamber which are divided. The refrigerant supplied through the suction port 117 may be introduced into the suction chamber through the intake 1301. Further, the refrigerant compressed in the compression chamber may be discharged to the outside of the compression part 130 through the discharge port 1303 and then discharged to the outside of the rotary compressor 100 through the discharge pipe 119.

[Oil Supply Structure through Shaft]

According to the embodiment, a lower region of the case 110 may be filled with oil. The oil may move in an upward direction through a hollow 1251 in the shaft 125 and may be transferred to the compression part 130.

The shaft 125 may be provided with an oil discharge hole 1253. The oil discharge hole 1253 may be formed to pass through the shaft 125 in the radial direction. The oil discharge hole 1253 may be disposed in the compression part 130, more specifically, in the compression space of each of the cylinders 131 and 132.

The oil discharged through the oil discharge hole 1253 may be supplied between the outer circumferential surface of the eccentric portion 126 and the inner circumferential surface of the roller 134, and between an outer circumferential surface of the roller 134 and an inner circumferential surface of each of the cylinders 131 and 132. Like the above, the oil supplied through the oil discharge hole 1253 may perform lubrication between the outer circumferential surface of the eccentric portion 126 and the inner circumferential surface of the roller 134 and perform lubrication between the outer circumferential surface of the roller 134 and the inner circumferential surface of each of the cylinders 131 and 132.

As an example, the shaft 125 is provided with an oil pump, and the oil which fills the lower region of the case 110 may be suctioned into the hollow 1251 in the shaft 125 through the oil pump.

As another example, the oil which fills the lower region of the case 110 may be suctioned into the hollow 1251 in the shaft 125 by a pressure difference. Since a pressure of the inside of the compression part 130 is relatively lower than a pressure of the outside of the compression part 130, oil at the outside of the compression part 130 may be suctioned into the hollow 1251 in the shaft 125 and transferred to the inside of the compression part 130 through the oil discharge hole 1253.

[Structure of Compression Part]

Hereinafter, the structure of the compression part will be described in detail with reference to FIGS. 6 to 8. For convenience of the description, here, a surrounding structure of the first cylinder will be representatively described.

However, it is noted that the structure exemplified in the embodiment may be applied to not only the first cylinder but also the second cylinder.

As described above, the compression space may be formed in the first cylinder 131. In the compression space, the roller 134 may be disposed. The eccentric portion 126 may be fit-coupled to the inner circumferential surface of the roller 134. The eccentric portion 126 may be provided in a shape protruding in a centrifugal direction from the shaft 125 which passes through an inner side in the radial direction of the roller 134.

When the shaft 125 rotates, the eccentric portion 126 is rotated due to rotation of the shaft 125, and the eccentric portion 126 is eccentrically rotated in the roller 134 so that the roller 134 revolves.

Further, a first member may be disposed at one side in the axial direction of the first cylinder 131, that is, an upper side, and a second member may be disposed at the other side in the axial direction of the cylinder 131, that is, a lower side. The first member may cover an upper portion of the first cylinder 131, and the second member may cover a lower portion of the second cylinder 132.

Accordingly, a space of which an upper portion is blocked by the first member and a lower portion is blocked by the second member, that is, the compression space, may be formed in the first cylinder 131.

According to the embodiment, the first member disposed at the one side in the axial direction of the first cylinder 131 may be the first bearing 136 which covers the upper portion of the first cylinder 131. Further, the second member disposed at the other side in the axial direction of the first cylinder 131 may be the middle plate 138 which covers the lower portion of the first cylinder 131.

As another example, with respect to the second cylinder 132 disposed under the first cylinder 131, the first member disposed at one side in the axial direction of the second cylinder 132 may be the middle plate 138 which covers the upper portion of the second cylinder 132. Further, the second member disposed at the other side in the axial direction of the second cylinder 132 may be the second bearing 137 which covers the lower portion of the second cylinder 132.

As still another example, when the compression part 130 is formed as one cylinder, the first member may be the first bearing 136 which covers the upper portion of the first cylinder 131 or second cylinder 132, and the second member may be the second bearing 137 which covers the lower portion of the first cylinder 131 or second cylinder 132.

Hereinafter, an example in which the first bearing 136 is disposed on the first cylinder 131 and the middle plate 138 is disposed under the first cylinder 131 is described.

In the embodiment, an example in which the middle plate 138 is connected to the suction port 117 is described. In the middle plate 138, a refrigerant flow path 1381 connected to the suction port 117 may be formed.

The refrigerant flow path 1381 may be opened to the outside of the middle plate 138 through an outer circumferential surface of the middle plate 138. The refrigerant flow path 1381 may be connected to the suction port 117 through an inlet side of the refrigerant flow path 1381 which is thus opened.

The refrigerant flow path 1381 may extend in a centripetal direction from the outer circumferential surface of the middle plate 138. An outlet side of the refrigerant flow path 1381 may be bifurcated. One of the bifurcated outlets may be connected to the compression space in the first cylinder 131 through an upper surface of the middle plate 138. Further, the other one of the bifurcated outlets may be connected to the compression space in the first cylinder 131 through a lower surface of the middle plate 138.

Among the above, the outlet side of the refrigerant flow path 1381 connected to the compression space in the first cylinder 131 through the upper surface of the middle plate 138 may be defined as the intake 1301 disposed in the compression space in the first cylinder 131.

According to the embodiment, the middle plate 138 may be disposed under the compression space formed in the first cylinder 131. Further, the intake 1301 formed on the middle plate 138 may also be disposed under the compression space.

At least a portion of the intake 1301 may overlap a moving path of the roller 134 which revolves in the compression space. That is, the roller 134 which compresses the refrigerant by revolving in the compression space may pass through a position overlapping the intake 1301 in the axial direction while moving.

Further, the first bearing 136 may be disposed on the compression space formed in the first cylinder 131. In addition, the first bearing 136 may be provided with the discharge port 1303. The discharge port 1303 may be formed to pass through the first bearing 136 in the axial direction, and the discharge port 1303 may be disposed above the compression space.

At least a portion of the discharge port 1303 may overlap the moving path of the roller 134 which revolves in the compression space. That is, the roller 134 which compresses the refrigerant by revolving in the compression space may pass through a position overlapping the discharge port 1303 in the axial direction while moving.

With respect to the vane 135, the intake 1301 may be disposed at the left portion of the vane 135, that is, the suction chamber, and the discharge port 1303 may be disposed at the right portion of the vane 135, that is, the compression chamber. In this case, the intake 1301 and the discharge port 1303 may be disposed adjacent to the vane 135.

In the embodiment, with respect to a rotation center of the shaft 125, an example in which the intake 1301 and the vane 135 are disposed to form an angle within 50° and the vane 135 and the discharge port 1303 are disposed to form an angle within 50° is described.

[Structure of Roller]

Figure 9:
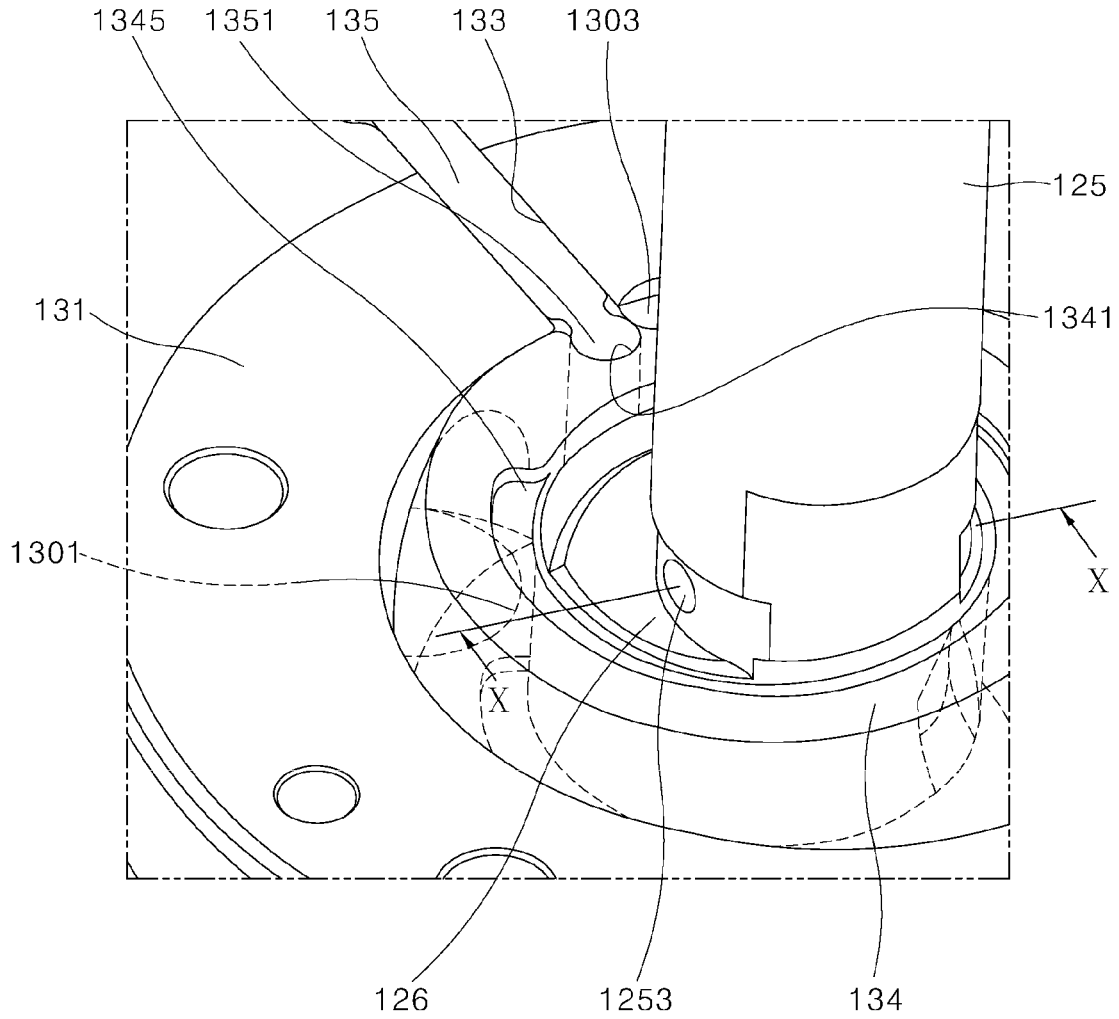
FIG. 9 is an enlarged view of portion IX in FIG. 8.
Figure 10:
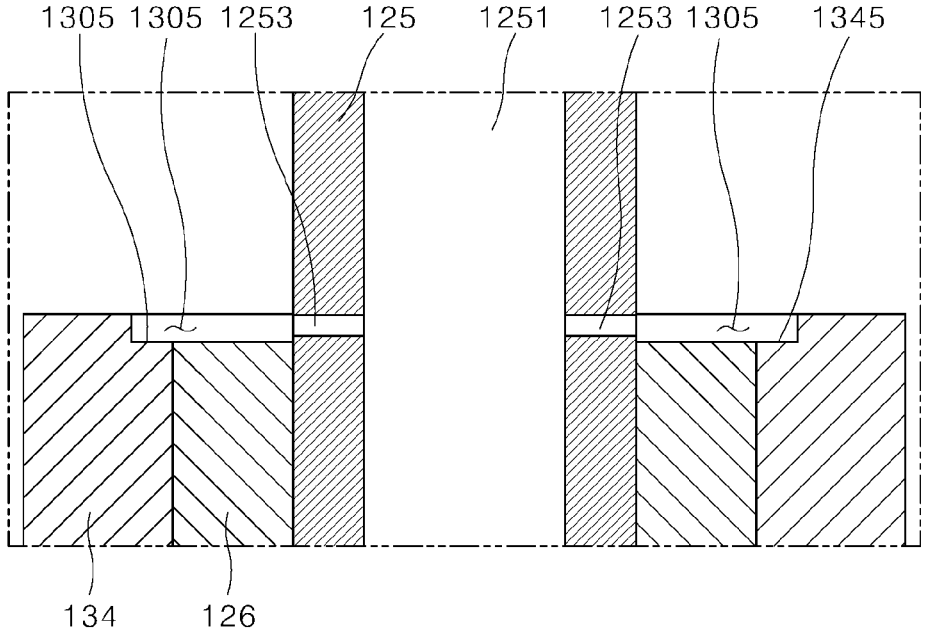
FIG. 10 is a cross-sectional view taken along line X-X in FIG. 9.
Figure 11:
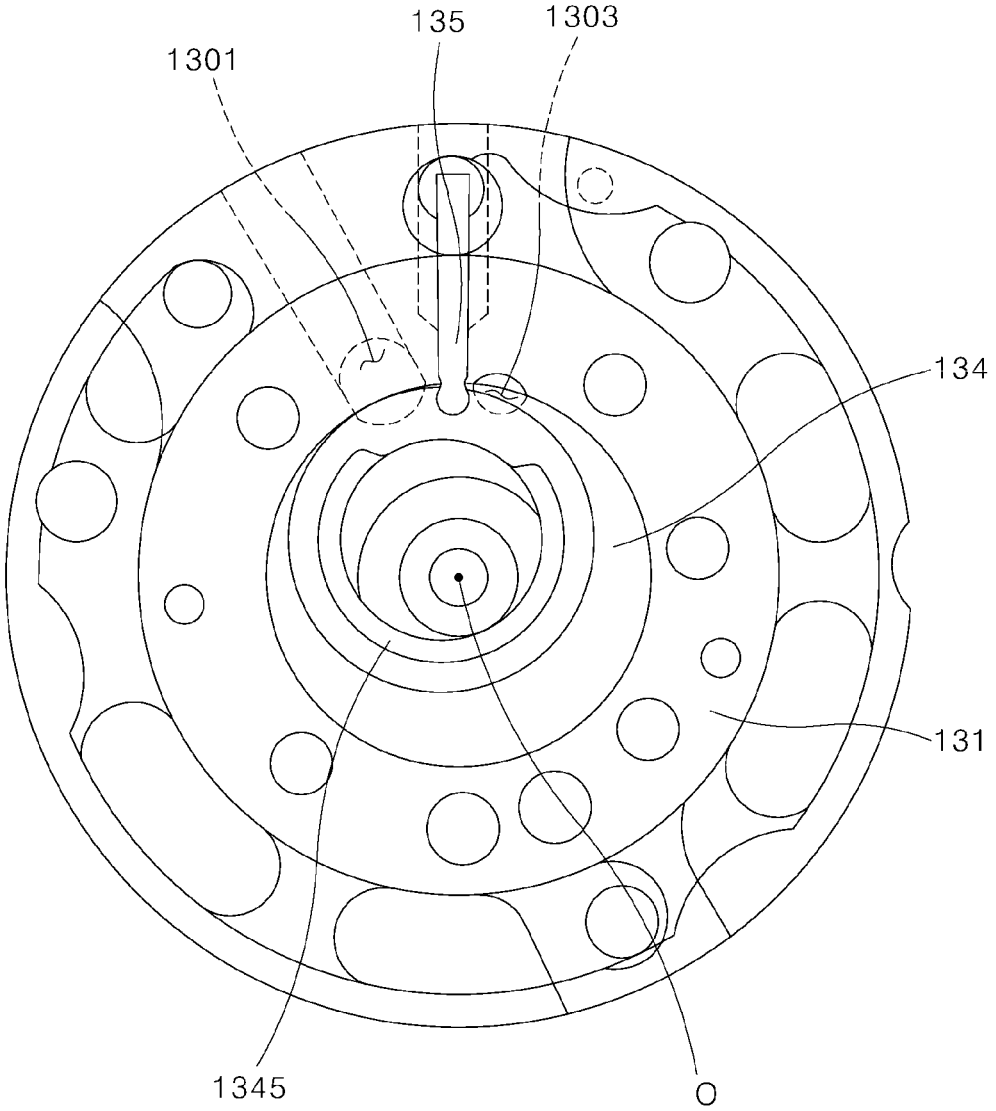
FIG. 11 is a lateral sectional view illustrating some components of the compression part shown in FIG. 8.

FIG. 9 is an enlarged view illustrating portion IX in FIG. 8, FIG. 10 is a cross-sectional view taken along line X-X in FIG. 9, and FIG. 11 is a lateral sectional view illustrating some components of the compression part shown in FIG. 8.

Hereinafter, the structure of the roller will be described in detail with reference to FIGS. 7 to 11. For convenience of the description, here, the structure of the roller installed in the first cylinder will be representatively described.

However, it is noted that the structure exemplified in the embodiment may be applied to not only the first cylinder but also the second cylinder.

Referring to FIGS. 7 to 9, the roller 134 may be provided with oil grooves 1345. The oil grooves 1345 may be formed in the inner circumferential surface of the roller 134 facing the eccentric portion 126. The oil grooves 1345 may be concavely formed in a centrifugal direction from the inner circumferential surface of the roller 134.

Further, the oil grooves 1345 may be formed to be recessed from the end portion of the roller 134 in the axial direction by a predetermined depth. That is, the oil grooves 1345 may be formed in an edge of the inner circumferential surface of the roller 134, concavely formed in the centrifugal direction from the inner circumferential surface of the roller 134, and concavely formed toward a center of the roller 134 in the axial direction from the end portion of the roller 134 in the axial direction.

The oil groove 1345 may be formed in each of one side end portion of the roller 134 in the axial direction (hereinafter, referred to as an "upper end portion of the roller") and the other side end portion of the roller 134 in the axial direction (hereinafter, referred to as a "lower end portion of the roller"). That is, the roller 134 may be provided with a pair of oil grooves 1345.

Referring to FIGS. 8 to 10, the pair of oil grooves 1345 may be symmetrically formed with respect to the center of the roller 134 in the axial direction. According to the roller 134 having the pair of oil grooves 1345, a shape of one side surface of the roller 134 in the axial direction and a shape of the other side surface of the roller 134 in the axial direction may be symmetrically formed with respect to the center of the roller 134 in the axial direction. That is, the shape of the one side surface of the roller 134 in the axial direction and the shape of the other side surface of the roller 134 in the axial direction are the same.

The roller 134 does not require direction classification according to a vertical direction. Accordingly, when the roller 134 is installed between the eccentric portion 126 and the first cylinder 131, an installing direction of the roller 134 does not have to be considered. Accordingly, even when the roller 134 is provided with the oil grooves 1345, the roller 134 may be easily assembled, and an occurrence of an assembly error through a process of assembling the roller 134 may significantly decrease.

Further, the oil groove 1345 may be formed to a depth in which the eccentric portion 126 does not protrude to an outer side of an axial direction of the oil groove 1345. Accordingly, the oil groove 1345 disposed at an upper portion may be formed so that an upper end portion of the eccentric portion 126 coupled to the roller 134 may be formed not to protrude to an upper portion of the oil groove 1345, and the oil groove 1345 disposed at a lower portion may be formed so that a lower end portion of the eccentric portion 126 coupled to the roller 134 may be formed not to protrude to a lower portion of the oil groove 1345.

That is, no portion of the outer circumferential surface of the eccentric portion 126 protrudes to an outer side of the inner circumferential surface of the roller 134. Accordingly, between the eccentric portion 126 and the roller 134, a state in which the outer circumferential surface of the eccentric portion 126 is entirely engaged with the inner circumferential surface of the roller 134 may be maintained.

Accordingly, a force applied to the outer circumferential surface of the eccentric portion 126 during a revolving process of the roller 134 may act not on a portion of the outer circumferential surface of the eccentric portion 126 but on the entire outer circumferential surface of the eccentric portion 126. Accordingly, since an area of the outer circumferential surface of the eccentric portion 126 which receives the force applied to the eccentric portion 126 may increase, a surface pressure per unit area received by the eccentric portion 126 may effectively decrease.

Referring to FIGS. 10 and 11, an oil accommodation space 1305 may be formed in each of the oil grooves 1345 formed like the above. The oil accommodation space 1305 is a space surrounded by the first member and the oil groove 1345 or a space surrounded by the second member and the oil groove 1345.

For example, the oil accommodation space 1305 surrounded by the first bearing 136 and the oil groove 1345 may be formed in one side of the roller 134 facing the first member. Further, the oil accommodation space 1305 surrounded by the middle plate 138 and the oil groove 1345 may be formed in the other side of the roller 134 facing the second member.

Each of the oil accommodation spaces 1305 formed in this way may be connected to a gap between the inner circumferential surface of the roller 134 and the outer circumferential surface of the eccentric portion 126. In the oil accommodation space 1305, oil which moves through the hollow 1251 in the shaft 125 may be filled.

As an example, the oil which moves through the hollow 1251 in the shaft 125 may be discharged to the outside of the shaft 125 through the oil discharge hole 1253. As described above, the oil discharged to the outside of the shaft 125 may be supplied to the oil accommodation space 1305.

The oil supplied to the oil accommodation space 1305 may be supplied to a gap connected to the oil accommodation space 1305, that is, the gap between the inner circumferential surface of the roller 134 and the outer circumferential surface of the eccentric portion 126.

The oil which is supplied like the above may perform the lubrication between the outer circumferential surface of the eccentric portion 126 and the inner circumferential surface of the roller 134 and perform the lubrication between the outer circumferential surface of the roller 134 and the inner circumferential surface of each of the cylinders 131 and 132.

The oil accommodation space 1305 may provide not only a path necessary to supply the oil discharged through the oil discharge hole 1253 to the gap between the inner circumferential surface of the roller 134 and the outer circumferential surface of the eccentric portion 126 (hereinafter, referred to as "a sliding portion"), but also a storage space necessary to fill the roller 134 with a predetermined amount of oil.

That is, some of the oil introduced into the oil accommodation space 1305 may be supplied to the sliding portion, and the remaining oil may fill the oil accommodation space 1305. Further, the oil which fills the oil accommodation space 1305 like the above may be supplied continuously little by little to the sliding portion.

When a state in which the oil receiving space 1305 is filled with oil of a predetermined amount or more is maintained, the oil may be supplied from an entire region surrounded by the oil accommodation space 1305 as well as a partial region of the outer circumferential surface of the eccentric portion 126 to the sliding portion.

Further, when the state in which the oil receiving space 1305 is filled with oil of the predetermined amount or more is maintained, a self-weight of the oil filled in the oil accommodation space 1305 may act as a force which introduces the oil into the sliding portion.

Accordingly, the oil may be stably supplied to the sliding portion, and oil supply to the sliding portion may be more smoothly performed from a relatively broader region. Accordingly, since a lubrication performance to components in the compression part 130 may be improved, and friction loss in the compression part 130 may decrease, operation reliability and operation efficiency of the rotary compressor may be further improved.

[Detailed Structure of Oil Groove]

Figure 12:
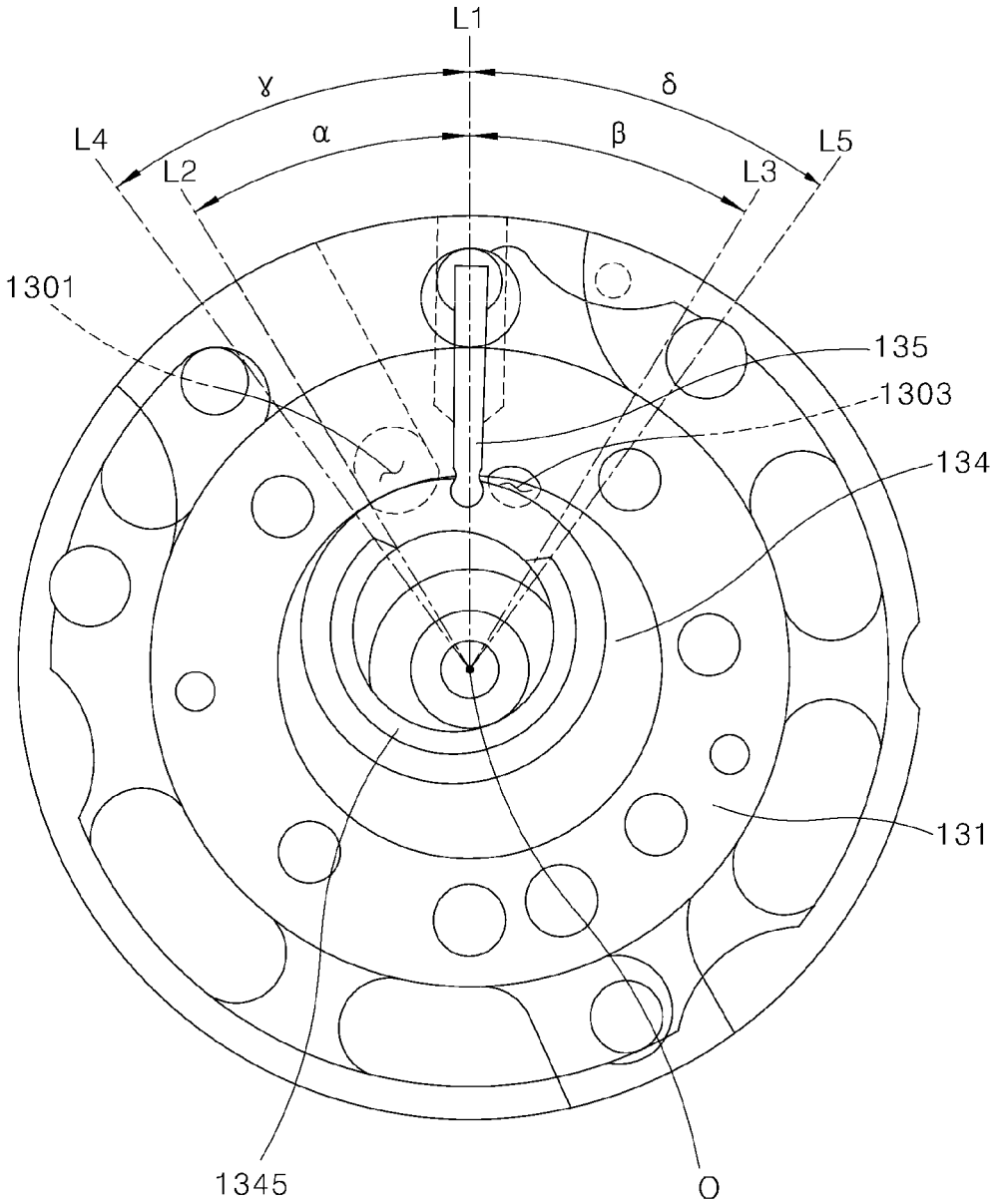
FIG. 12 is a view for describing a shape of an oil groove shown in FIG. 11.

FIG. 12 is a view for describing a shape of the oil groove shown in FIG. 11.

Hereinafter, a specific shape of the oil groove will be described in detail with reference to FIG. 12.

Terms will be defined. A first virtual line L1 is a virtual line which connects a rotation center O of the shaft 125 and the vane 135 in a radial direction. A second virtual line L2 is a virtual line which connects the rotation center O of the shaft 125 and the intake 1301 and connects a point of the intake 1301 which is farthest away from the first virtual line L1 and the rotation center O of the shaft 125. A third virtual line L3 is a virtual line which connects the rotation center O of the shaft 125 and the discharge port 1303 in a radial direction and connects a point of the discharge port 1303 which is farthest away from the first virtual line L1 and the rotation center O of the shaft 125.

Further, a first angle (α) is an angle between the first virtual line L1 and the second virtual line L2 with respect to the first virtual line L1, and a second angle (β) is an angle between the first virtual line L1 and the third virtual line L3 with respect to the first virtual line L1. In this case, the angle is measured in a counterclockwise direction.

Further, a fourth virtual line L4 is a virtual line which connects the rotation center O of the shaft 125 and one end of a circumferential direction of the oil grooves 1345. A fifth virtual line L5 is a virtual line which connects the rotation center O of the shaft 125 and the other end of the circumferential direction of the oil grooves 1345.

Further, a third angle (γ) is an angle between the first virtual line L1 and the fourth virtual line L4 with respect to the first virtual line L1, and a fourth angle (δ) is an angle between the first virtual line L1 and the fifth virtual line L5 with respect to the first virtual line L1.

According to the embodiment, each of the third angle (γ) and the fourth angle (δ) may be set as a range between the first angle (α) and the second angle (β). That is, a forming range of the oil groove 1345 according to the circumferential direction may be set as the range between the first angle (α) and the second angle (β).

In the embodiment, an example in which the first angle is (α) is 0 to 50°, and the second angle (β) is 310 to 360° is described. That is, in the embodiment, an example in which the intake 1301 is disposed in a region forming an angle in a range of 0 to 50° with the vane 135, and the discharge port 1303 is disposed in a region forming an angle in a range of 310 to 360° with the vane 135 is described.

In consideration of arrangement positions of the intake 1301 and the discharge port 1303, the third angle (γ) may be set as a range between the first angle (α) and the second angle (β), and the fourth angle (δ) may also be set as a range between the first angle (α) and the second angle (β).

For example, when the first angle (α) is 50° and the second angle (β) is 310°, each of the third angle (γ) and the fourth angle (δ) may be determined as being in a range between 50° to 310°.

In this case, the fourth angle (δ) is determined as an angle greater than the third angle (γ). A difference between the third angle (γ) and the fourth angle (δ) may indicate a length of the circumferential direction of the oil groove 1345, and accordingly, it may be understood that the length of the circumferential direction of the oil groove 1345 increases when the difference between the third angle (γ) and the fourth angle (δ) is large.

In summary, the oil groove 1345 is formed in the inner circumferential surface of the roller 134 in the circumferential direction and is formed in a shape which may not overlap the intake 1301 and the discharge port 1303 in the axial direction. For example, the oil groove 1345 may be formed in a C shape of which both end portions in the circumferential direction are disposed to be spaced apart from each other.

According to the embodiment, the roller 134 which compresses the refrigerant by revolving in the compression space may pass through the position overlapping the intake 1301 in the axial direction and the position overlapping the discharge port 1303 in the axial direction while moving.

The oil grooves 1345 exemplified in the embodiment may be formed not to overlap the intake 1301 and the discharge port 1303 in the axial direction despite the movement of the above-described roller 134.

To this end, the inside of the compression space is divided in the circumferential direction and may be divided into an arrangement region of the intake 1301 and the discharge port 1303 and an arrangement region of the oil grooves 1345. Accordingly, a region between the second virtual line L2 and the third virtual line L3 (an inner angle region) may be divided as the arrangement region of the intake 1301 and the discharge port 1303, and a region between the fourth virtual line L4 and the fifth virtual line L5 (an outer angle region) may be divided as the arrangement region of the oil grooves 1345.

Accordingly, the shape and length of the oil groove 1345 may be set so that any portion of the oil groove 1345 is not located at the arrangement region of the intake 1301 and the discharge port 1303. Accordingly, the oil groove 1345 may be formed not to overlap the intake 1301 and discharge port 1303 in the axial direction.

Further, the oil grooves 1345 may be symmetrically formed with respect to the first virtual line L1. Generally, considering that the intake 1301 is formed to be greater than the discharge port 1303, the shape and length of the oil groove 1345 may be mainly influenced by the size of the intake 1301.

When the above is expressed as a formula, in the case in which α is greater than or equal to 360-β, it is expressed that γ is greater than or equal to α and is smaller than 360-α, and δ is greater than α and is smaller than or equal to 360-α.

In this case, the oil grooves 1345 may be formed to be continuously connected along the circumferential direction in a range of α° to 360°-α°.

When the discharge port 1303 is formed to be greater than the intake 1301, that is, when α is smaller than or equal to 360-β, it may be expressed that γ is greater than or equal to β and is smaller than 360-β, and δ is greater than β and is smaller than or equal to 360-β.

Like the above, when the oil grooves 1345 are formed in a laterally symmetrical shape, the roller 134 may also be formed in a laterally symmetrical shape. The roller 134 does not require direction classification according to the lateral direction and the vertical direction. Accordingly, when the roller 134 is installed between the eccentric portion 126 and the first cylinder 131, an installing direction of the roller 134 does not have to be considered.

Accordingly, not only an effect that the roller 134 may be easily assembled, and the assembly error in the process of assembling the roller 134 may significantly decrease, but also an effect that the roller 134 is compatible with various types of rotary compressors having different positions, sizes, and shapes of the intake 1301 and the discharge port 1303 may be provided.

[Action and Effect of Rotary Compressor]

Referring to FIGS. 10 and 12, the roller 134 is provided with the oil grooves 1345, and the oil groove 1345 is formed in a shape not overlapping the intake 1301 and the discharge port 1303 in the axial direction.

According to the embodiment, the intake 1301 is disposed in a region corresponding to the first angle (α) in the compression space (hereinafter, referred to as "an arrangement region of the intake"), and the discharge port 1303 is disposed in a region corresponding to the second angle (β) in the compression space (hereinafter, referred to as "an arrangement region of the discharge port"). That is, the intake 1301 is disposed in a range corresponding to 0 to 50° in the compression space, and the discharge port 1303 is disposed in a range corresponding to 310 to 360° in the compression space.

Further, the oil grooves 1345 are formed to be located in a region in the compression space other than the regions corresponding to the first angle (α) and the second angle (β), that is, the arrangement regions of the intake and the discharge port. That is, the oil grooves 1345 may be formed in the compression space to be located in in a range corresponding to 50 to 310°.

According to the embodiment, the roller 134 which compresses the refrigerant by revolving in the compression space may pass through the position overlapping the intake 1301 in the axial direction while moving. However, even when the roller 134 and the intake 1301 are located at the position overlapping each other in the axial direction or the roller 134 and the discharge port 1303 are located at the position overlapping each other in the axial direction, the oil grooves 1345 do not overlap the intake 1301 or the discharge port 1303 in the axial direction.

The above is a result of a geometric design of the oil groove 1345 intended to prevent the oil grooves 1345 from overlapping the intake 1301 and the discharge port 1303 in the axial direction regardless of the position of the roller 134.

Accordingly, since connection between the oil groove 1345 and the intake 1301, and connection between the oil groove 1345 and the discharge port 1303 become difficult, leakage of a refrigerant through the oil grooves 1345 may be effectively restrained Further, the above-described oil grooves 1345 are not formed in only a region biased to a slide surface of the suction chamber or only a region biased to a slide surface of the compression chamber on the roller 134. In the embodiment, the oil grooves 1345 may be formed on the roller 134 to be located in most of the remaining region other than the arrangement region of the intake and the arrangement region of the discharge port.

That is, the oil grooves 1345 may be formed in a region including both the region biased to the slide surface of the suction chamber and the region biased to the slide surface of the compression chamber. Accordingly, the oil may be sufficiently supplied not to a partial region of the sliding portion but to most of the region of the sliding portion.

Figure 5:
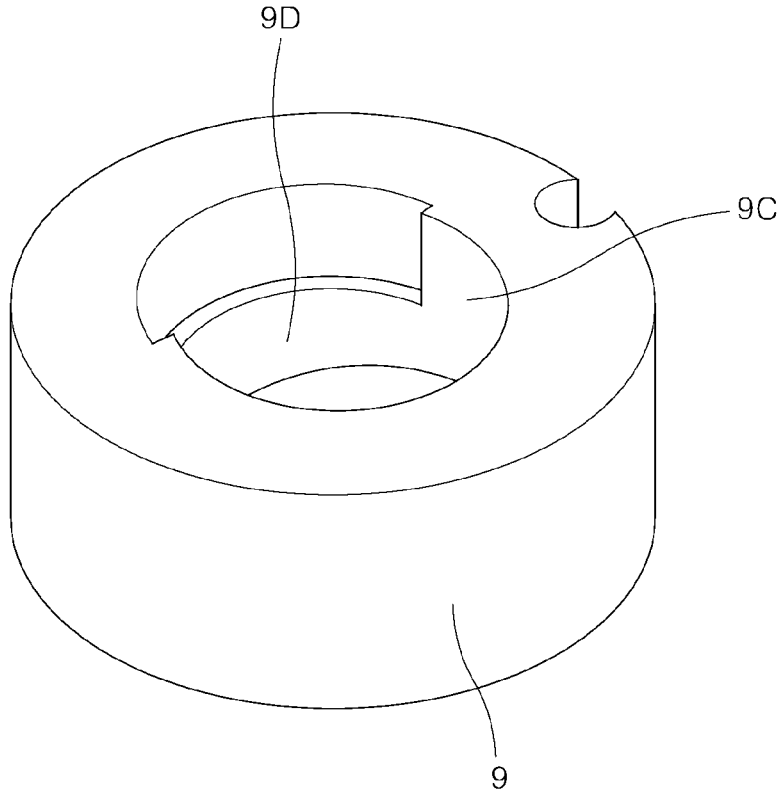
FIG. 5 is a perspective view illustrating a roller shown in FIG. 4.

In the conventional rotary compressor, the narrow slide portion 9D is formed in only a region biased to the slide surface of the suction chamber, and accordingly, there was a problem in that lubrication between the shaft 4 and the roller 9 in the compression chamber 13 which receives the most load from the eccentric portion 4A of the shaft 4 becomes weak (see FIG. 5).

On the other hand, in the rotary compressor of the embodiment, the oil grooves 1345 are formed over most areas other than some areas corresponding to the arrangement regions of the intake and the discharge port. Accordingly, a space required to secure oil can be sufficiently provided over most areas of the roller 134.

Accordingly, the oil may be stably supplied to the sliding portion, and the oil supply to the sliding portion may be more smoothly performed from the relatively broader region. Accordingly, since the lubrication performance to the components in the compression part 130 may be improved and the friction loss in the compression part 130 may decrease, the operation reliability and the operation efficiency of the rotary compressor may be further improved.

Meanwhile, the oil groove 1345 may be formed to the depth in which the eccentric portion 126 does not protrude to the outer side of the axial direction of the oil groove 1345. That is, no portion of the outer circumferential surface of the eccentric portion 126 protrudes to the outer side of the inner circumferential surface of the roller 134. Accordingly, the state in which the outer circumferential surface of the eccentric portion 126 is entirely engaged with the inner circumferential surface of the roller 134 may be maintained.

Accordingly, since the surface pressure per unit area received by the eccentric portion 126 may effectively decrease, structural stability of the rotary compressor may be further improved.

Further, the pair of oil grooves 1345 may be symmetrically formed in the roller 134 with respect to the center of the axial direction of the roller 134. The roller 134 does not require the direction classification according to the vertical direction.

Accordingly, even when the roller 134 is provided with the oil grooves 1345, an effect may be provided that the roller 134 may be easily assembled, and an assembly error in the process of assembling the roller 134 is significantly decreased.

Further, the oil groove 1345 is formed to a maximum length in the roller 134 within a range which allows leakage occurrence of the refrigerant to be minimized. In addition, the oil groove 1345 is formed in not only the one side but also the other side in the axial direction of the roller 134. That is, the oil grooves 1345 may be provided in the roller 134 as long as possible and as many as possible.

Accordingly, a weight of the roller 134 may be reduced by a volume occupied by the oil grooves 1345. Like the above, since the weight of the roller 134 is reduced, a load necessary for revolution of the roller 134 may be reduced, and accordingly, an effect that efficiency of the rotary compressor is improved may be provided.

According to a rotary compressor of the present disclosure, since oil supply between a shaft and a roller is smoothly performed through oil grooves formed in the roller and the oil grooves are not connected to an intake and a discharge port, an effect is provided that a lubrication performance between the shaft and the roller can be improved and leakage of a refrigerant through the oil grooves can be effectively restrained.

Further, in the present disclosure, the oil grooves are formed in the roller so that any portion of an outer circumferential surface of an eccentric portion does not protrude to an outer side of an inner circumferential surface of the roller, and accordingly, a state in which the outer circumferential surface of the eccentric portion is entirely engaged with the inner circumferential surface of the roller can be maintained.

Accordingly, in the present disclosure, since a surface pressure per unit area received by the eccentric portion effectively decreases, structural stability of the rotary compressor can be further improved.

Further, according to the present disclosure, the oil grooves are formed over most areas other than some areas corresponding to arrangement regions of the intake and the discharge port, and accordingly, a space required to secure oil can be sufficiently provided over most areas of the roller.

Accordingly, in the present disclosure, since a lubrication performance of inner components of a compression part can be improved and friction loss in the compression part can decrease, a rotary compressor with improved operation reliability and operation efficiency can be provided.

Further, according to the present disclosure, a pair of oil grooves are symmetrically formed in the roller with respect to the center in an axial direction of the roller, and the roller does not requires direction classification according to a vertical direction.

Accordingly, in the present disclosure, even when the oil grooves are provided in the roller, an effect that the roller can be easily assembled, and an assembly error in a process of assembling the roller significantly decreases can be provided.

Further, in the present disclosure, the oil grooves can be provided in the roller as long as possible and as many as possible, and accordingly, a weight of the roller can be reduced, and thus a rotary compressor of which efficiency is further improved can be provided.

As described above, the present disclosure has been described with reference to embodiments shown in the drawings but these are only exemplary, and it may be understood by those skilled in the art that various modifications and other equivalents are possible therefrom. Accordingly, the technical scope of the present disclosure should be determined by the technical spirit of the appended claims.

What is claimed is:

1. A rotary compressor comprising:

a cylinder axially extending between a first axial end and a second axial end and defining a compression space;

a ring-shaped roller received in the cylinder and configured to compress a substance in the compression space;

a vane connected to the roller and configured to divide the compression space into a suction chamber and a compression chamber;

a shaft including an eccentric portion configured to engage with an inner circumference of the roller, wherein the eccentric portion is configured to, based on rotation of the shaft, eccentrically rotate to revolve the roller around the shaft;

a first member disposed at the first axial end of the cylinder and including an intake port fluidly connected to the suction chamber; and a second member disposed at the second axial end of the cylinder and including a discharge port fluidly connected to the compression chamber, wherein the roller includes at least one oil groove that is defined at the inner circumference of the roller and faces the eccentric portion, wherein the at least one oil groove is spaced apart from, in a circumferential direction, the intake port of the first member and the discharge port of the second member, wherein the at least one oil groove is defined at a first axial end of the roller, and wherein the at least one oil groove is recessed from the first axial end of the roller by a predetermined depth such that the eccentric portion does not extend axially beyond an axial end of the at least one oil groove.

2. The rotary compressor of claim 1, wherein the at least one oil groove has a first end and a second end and extends between the first end and the second end along the inner circumference of the roller.

3. The rotary compressor of claim 2, wherein a first virtual line extends between a rotation axis of the shaft and the vane and lies on a virtual plane that is perpendicular to the rotation axis, wherein a second virtual line extends between the rotation axis of the shaft and the intake port and lies on the virtual plane, wherein a third virtual line extends between the rotation axis of the shaft and the discharge port and lies on the virtual plane, wherein a fourth virtual line extends between the rotation axis of the shaft and the first end of the at least one oil groove and lies on the virtual plane, wherein a fifth virtual line extends between the rotation axis of the shaft and the second end of the at least one oil groove and lies on the virtual plane, wherein a first angle is defined between the first virtual line and the second virtual line in a first angular direction, wherein a second angle is defined between the first virtual line and the third virtual line in the first angular direction, wherein a third angle is defined between the fourth virtual line and the rotation axis of the shaft in the first angular direction, wherein a fourth angle is defined between the fifth virtual line and the rotation axis of the shaft in the first angular direction, and wherein each of the third angle and the fourth angle has a value that ranges between a first value of the first angle and a second value of the second angle.

4. The rotary compressor of claim 3, wherein the second virtual line extends between the rotation axis of the shaft and an end of the intake port that is farthest from the first virtual line, and wherein the third virtual line extends between the rotation axis of the shaft and an end of the discharge port that is farthest from the first virtual line.

5. The rotary compressor of claim 3, wherein the first value of the first angle ranges from 0 to 50°, and wherein the second value of the second angle ranges from 310 to 360°.

6. The rotary compressor of claim 5, wherein the value of each of the third angle and the fourth angle ranges from 50 to 310°.

7. The rotary compressor of claim 6, wherein the first angle is greater than or equal to a first subtraction value of subtracting the second angle from 360, and wherein the third angle is greater than or equal to the first angle and smaller than a second subtraction value of subtracting the first angle from 360.

8. The rotary compressor of claim 7, wherein the fourth angle is greater than the third angle and smaller than or equal to the second value.

9. The rotary compressor of claim 8, wherein the at least one oil groove is defined as continuously extending along the inner circumference of the roller in a range between the first angle and the second subtraction value.

10. The rotary compressor of claim 3, wherein the at least one oil groove is symmetrically positioned with respect to the first virtual line.

11. The rotary compressor of claim 1, wherein the at least one oil groove is at least one first oil groove, and wherein the roller includes at least one second oil groove defined at a second axial end of the roller that is axially opposite to the first axial end of the roller.

12. The rotary compressor of claim 11, wherein the at least one first oil groove and the at least one second oil groove are symmetrically positioned with respect to the rotation axis of the roller.

13. The rotary compressor of claim 11, wherein the at least one first oil groove has a first oil accommodation space defined by the first member and the at least one first oil groove, wherein the at least second oil groove has a second oil accommodation space defined by the second member and the at least one second oil groove, and wherein each of the first and second oil accommodation spaces is fluidly connected to a gap between the inner circumference of the roller and an outer circumference of the eccentric portion.

14. The rotary compressor of claim 1, wherein the at least one oil groove has an oil accommodation space defined by the first member and the at least one oil groove, and wherein the oil accommodation space is fluidly connected to a gap between the inner circumference of the roller and an outer circumference of the eccentric portion.

15. The rotary compressor of claim 1, wherein the at least one oil groove includes a C-shape having opposite ends that are circumferentially spaced from each other along the inner circumference of the roller.

16. The rotary compressor of claim 1, wherein the first member is a plate that covers the first axial end of the cylinder.

17. The rotary compressor of claim 16, wherein the second member is a bearing that covers the second axial end of the cylinder.

18. The rotary compressor of claim 1, wherein the cylinder includes a vane slot, the vane at least partially inserted in the vane slot and configured to linearly move along the vane slot to divide the compression space into the suction chamber and the compression chamber.

* * * * *